US011933302B2

(12) United States Patent
Uchikai et al.

(10) Patent No.: US 11,933,302 B2
(45) Date of Patent: Mar. 19, 2024

(54) ROTARY COMPRESSOR

(71) Applicant: FUJITSU GENERAL LIMITED, Kanagawa (JP)

(72) Inventors: Hideto Uchikai, Kanagawa (JP); Motonobu Furukawa, Kanagawa (JP); Hiroki Katayama, Kanagawa (JP); Takahiro Sasaki, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/910,242

(22) PCT Filed: Mar. 30, 2021

(86) PCT No.: PCT/JP2021/013690
§ 371 (c)(1),
(2) Date: Sep. 8, 2022

(87) PCT Pub. No.: WO2021/201033
PCT Pub. Date: Oct. 7, 2021

(65) Prior Publication Data

US 2023/0120434 A1 Apr. 20, 2023

(30) Foreign Application Priority Data

Mar. 30, 2020 (JP) ..... 2020-061245

(51) Int. Cl.
*F04C 18/356* (2006.01)
*F04C 29/12* (2006.01)

(52) U.S. Cl.
CPC ..... *F04C 18/356* (2013.01); *F04C 29/12* (2013.01)

(58) Field of Classification Search
CPC .. F04C 18/356; F04C 29/12; F04C 2250/102; F04C 18/3564; F04C 23/008; F04C 29/126
See application file for complete search history.

(56) References Cited

U.S. PATENT DOCUMENTS 6,213,732 B1 * 4/2001 Fujio ..... F04C 29/068 181/403
6,447,274 B1 * 9/2002 Horihata ..... F04C 29/065 418/179

(Continued)

FOREIGN PATENT DOCUMENTS

CN 103790827 A 5/2014
CN 207033735 U 2/2018

(Continued)

OTHER PUBLICATIONS

Sep. 29, 2022, English translation of International Preliminary Report on Patentability issued for related PCT Application No. PCT/JP2021/013690.

(Continued)

*Primary Examiner* — Jesse S Bogue
(74) *Attorney, Agent, or Firm* — Paratus Law Group, PLLC

(57) ABSTRACT

Provided is a rotary compressor excellent in energy saving performance and reliability that can suppress over-compression of a compressed refrigerant compressed in a compression chamber. A rotary compressor includes a discharge port provided on an end plate and partially located outside a cylinder inner wall and a discharge groove provided on the cylinder inner wall and communicating with a compression chamber and the discharge port, the compression chamber compressing a refrigerant by contracting as an annular piston revolves, in which the discharge port faces an end (Continued)

portion of a vane groove on the cylinder inner wall on the compression chamber side.

5 Claims, 6 Drawing Sheets

(56) References Cited

U.S. PATENT DOCUMENTS

| | | | | |
|---|---|---|---|---|
| 9,004,888 | B2 * | 4/2015 | Morishita | F04C 18/22 418/60 |
| 2007/0269328 | A1 * | 11/2007 | Hasegawa | F04C 23/008 418/83 |
| 2009/0180912 | A1 * | 7/2009 | Morozumi | F04C 18/3564 418/229 |
| 2014/0119968 | A1 | 5/2014 | Morishita | |

FOREIGN PATENT DOCUMENTS

| | | | |
|---|---|---|---|
| JP | S52-060912 | U | 5/1977 |
| JP | S62-156181 | U | 10/1987 |
| JP | 2013-076337 | A | 4/2013 |
| JP | 2014-088836 | A | 5/2014 |
| JP | 2016-160793 | A | 9/2016 |

OTHER PUBLICATIONS

Jan. 2, 2024, Chinese Office Action issued for related CN Application No. 202180019273.9.

* cited by examiner

ROTARY COMPRESSOR

CROSS REFERENCE TO PRIOR APPLICATION

This application is a National Stage Patent Application of PCT International Patent Application No. PCT/JP2021/013690 (filed on Mar. 30, 2021) under 35 U.S.C. § 371, which claims priority to Japanese Patent Application No. 2020-061245 (filed on Mar. 30, 2020), which are all hereby incorporated by reference in their entirety.

TECHNICAL FIELD

The present invention relates to a rotary compressor for use in a refrigeration cycle of an air conditioner device.

BACKGROUND ART

FIG. 7 is an enlarged cross-sectional view illustrating first and second compression units of a conventional rotary compressor. As illustrated in FIG. 7, the conventional rotary compressor includes a compression unit 12 that includes annular cylinders 121S and 121T where suction ports (not illustrated) and vane grooves 128S and 128T are radially provided on a side portion, an end plate (not illustrated) that closes an end portion of the cylinders 121S and 121T, annular pistons 125S and 125T that are fitted to eccentric portions 152S and 152T (not illustrated) of a rotating shaft rotationally driven by a motor and that revolve in the cylinders 121S and 121T along cylinder inner walls 123S and 123T of the cylinders 121S and 121T to form working chambers 130S and 130T between the cylinder inner walls 123S and 123T and the annular pistons 125S and 125T, and vanes 127S and 127T that protrude into the working chambers 130S and 130T from an inside of vane grooves 128S and 128T provided in the cylinders 121S and 121T and abut on the annular pistons 125S and 125T to divide the working chambers 130S and 130T into suction chambers 131S and 131T and compression chambers 133S and 133T. Near the vane grooves 128S and 128T on the end plate (not illustrated) are provided discharge ports 190S and 190T that discharge a compressed refrigerant in the compression chambers 133S and 133T to an outside of the compression chambers 133S and 133T. Near the vane grooves 128S and 128T of the cylinders 121S and 121T are provided notch portions (discharge grooves) 137S and 137T that guide the compressed refrigerant in the compression chambers 133S and 133T into the discharge ports 190S and 190T.

One of edges of the notch portion formed by an inner peripheral surface of the notch portions 137S and 137T and a cylinder inner wall surface on the compression chamber 133S and 133T side is arranged so as to be positioned at a corner portion formed by an inner peripheral surface of the vane grooves 128S and 128T and the cylinder inner wall surface on the compression chamber 133S and 133T side. In other words, one of the edges of the notch portion formed by the inner peripheral surface of the notch portions 137S and 137T and the surface of the cylinder inner walls 123S and 123T is arranged so as to overlap with the corner portion formed by the inner peripheral surface of the vane grooves 128S and 128T and the surface of the cylinder inner walls 123S and 123T. Therefore, even after the first and second annular pistons 125S and 125T revolve counterclockwise, then a contact point between the first and second annular pistons 125S and 125T and the first and second cylinder inner walls 123S and 123T approaches the first and second vane grooves 128S and 128T, and the first and second annular pistons 125S and 125T completely close the first and second discharge ports 190S and 190T, the notch portions 137S and 137T allow first and second small spaces 138S and 138T of the first and second compression chambers 133S and 133T to communicate with the first and second discharge ports 190S and 190T to cause a compressed refrigerant gas in the first and second small spaces 138S and 138T to escape into the first and second discharge ports 190S and 190T, which prevents over-compression of the refrigerant to reduce over-compression loss, enabling improved compression efficiency.

CITATION LIST

Patent Literature

PTL 1: JP 2014-88836 A

SUMMARY OF INVENTION

Technical Problem

However, in the conventional technology disclosed in PTL 1, one of the edges of the notch portion formed by the inner peripheral surface of the notch portions 137S and 137T and the surface of the cylinder inner walls 123S and 123T is arranged so as to overlap with the corner portion formed by the inner peripheral surface of the vane grooves 128S and 128T and the surface of the cylinder inner walls 123S and 123T in the design. When there is any misalignment between one of the edges of the notch portion and the above corner portion in manufacturing, the first and second small spaces 138S and 138T remain immediately before a top dead center of the first and second annular pistons 125S and 125T, as a result of which over-compression of the refrigerant cannot be prevented.

Additionally, when one of the edges of the notch portion of the notch portions 137S and 137T overlaps with the position of the corner portion formed by the inner peripheral surface of the vane grooves 128S and 128T and the cylinder inner wall surface on the compression chamber side, a wall portion formed by the inner peripheral surface of the vane grooves 128S and 128T and the inner peripheral surface of the notch portions 137S and 137T is formed into an acute angle shape. Therefore, there is also a problem in terms of reliability where the wall portion formed into the acute angle shape is likely to be chipped.

In view of the above problems, a first object of the present invention is to prevent over-compression of a refrigerant to reduce over-compression loss, improving compression efficiency. A second object of the present invention is to provide a rotary compressor excellent in reliability by preventing the wall portion formed by the inner wall surface of the vane grooves 128S and 128T and the inner peripheral wall surface of the notch portions 137S and 137T from being formed into an acute angle shape.

Solution to Problem

According to one aspect of the present invention, there is provided with a rotary compressor including: an annular cylinder including a suction port and a vane groove; an end plate configured to close an end portion of the cylinder; a discharge port provided on the end plate and partially located outside a cylinder inner wall of the cylinder; an annular piston fitted to an eccentric portion of a rotating shaft rotationally driven by a motor, the annular piston revolving in the cylinder along the cylinder inner wall to form a working chamber with the cylinder inner wall; and a vane configured to protrude into the working chamber from the vane groove provided in the cylinder and abut on the annular piston to divide the working chamber into a suction chamber communicating with the suction port and a compression chamber communicating with the discharge port, wherein the compression chamber compresses a refrigerant by contracting as the annular piston revolves, and the discharge port faces a corner portion formed by an inner wall of the vane groove and the cylinder inner wall on the compression chamber side.

According to another aspect of the present invention, there is provided with a rotary compressor that is the rotary compressor of the one aspect in which the cylinder inner wall on the compression chamber side is formed with a discharge groove communicating with the compression chamber and the discharge port, edge portions on both sides of the discharge groove formed by the inner peripheral wall of the discharge groove and the cylinder inner wall being away from the corner portion formed by the inner wall of the vane groove and the cylinder inner wall on the compression chamber side.

Advantageous Effects of Invention

According to the rotary compressor of the one aspect, since the discharge port faces the corner portion formed by the inner wall of the vane groove and the cylinder inner wall on the compression chamber side, the compression chamber formed between the cylinder inner wall and the annular piston communicates with the discharge port until the annular piston reaches the top dead center. Thus, the compressed refrigerant compressed in the compression chamber does not remain, which can suppress over-compression of the refrigerant.

According to the rotary compressor of the other aspect, the edge portions on both sides of the discharge groove formed by the inner peripheral wall of the discharge groove and the cylinder inner wall are away from the corner portion formed by the inner wall of the vane groove and the cylinder inner wall on the compression chamber side. This can suppress the wall portion formed by the inner wall surface of the vane groove and the inner peripheral wall surface of the notch portion from being easily chipped.

DESCRIPTION OF EMBODIMENTS

Examples of a rotary compressor according to the present invention are described in detail with reference to the drawings. It should be noted that the present invention is not limited to the following Examples.

Example 1

Figure 1:
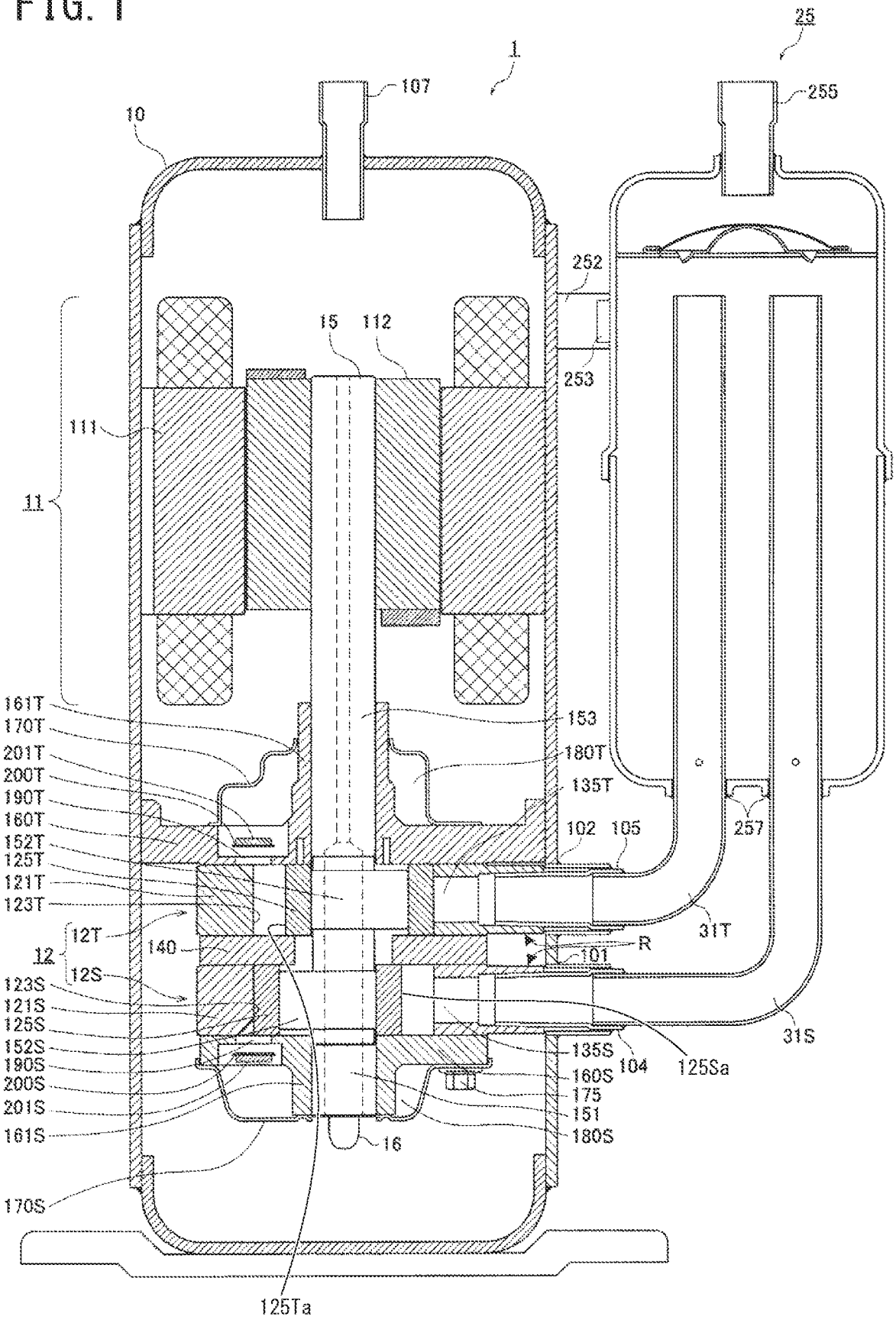
FIG. 1 is a longitudinal cross-sectional view of a rotary compressor according to the present invention.
Figure 2:
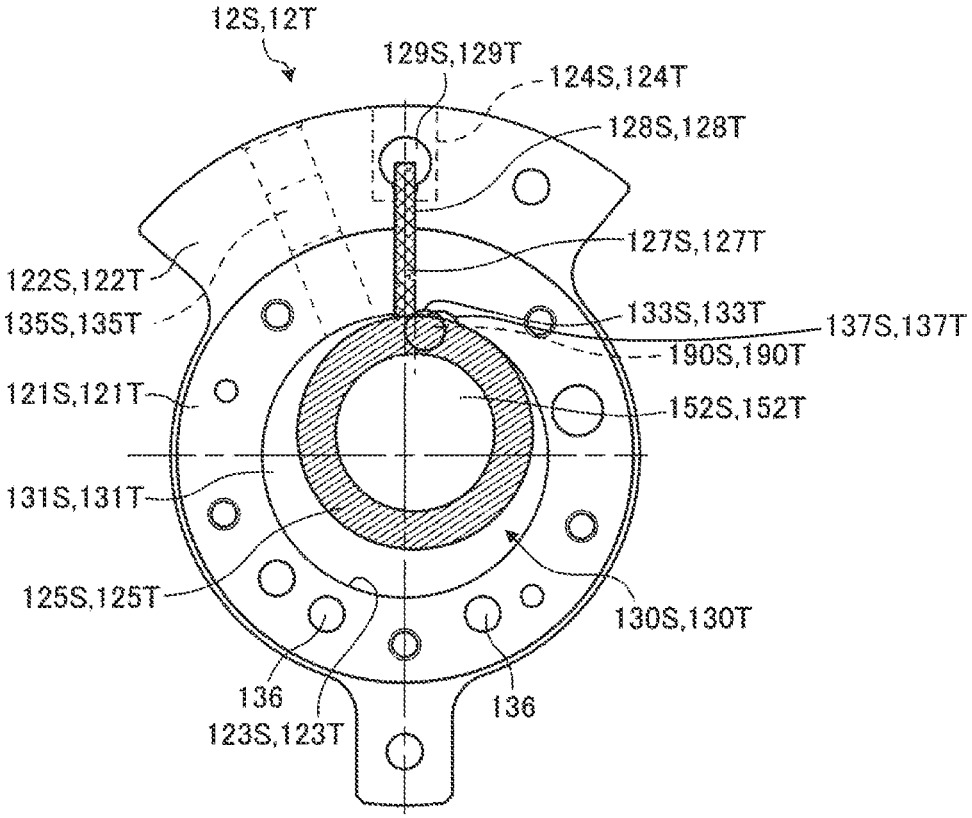
FIG. 2 is a plan view illustrating a compression unit of the rotary compressor according to the present invention.

FIG. 1 is a longitudinal cross-sectional view illustrating an Example of a rotary compressor according to the present invention. FIG. 2 is a plan view illustrating first and second compression units of Example 1.

As illustrated in FIG. 1, a rotary compressor 1 of Example 1 includes a compression unit 12 arranged in a lower part of a vertically-positioned airtight compressor housing 10 having a cylindrical shape and a motor 11 that is arranged in an upper part of the compressor housing 10 and that drives the compression unit 12 via a rotating shaft 15.

A stator 111 of the motor 11 is formed in a cylindrical shape and is shrink-fitted and fixed to an inner peripheral surface of the compressor housing 10. A rotor 112 of the motor 11 is arranged inside the cylindrical stator 111, and is shrink-fitted and fixed to the rotating shaft 15 that mechanically connects the motor 11 to the compression unit 12.

The compression unit 12 includes a first compression unit 12S and a second compression unit 12T arranged in parallel with the first compression unit 12S and stacked above the first compression unit 12S. As illustrated in FIG. 2, the first compression unit 12S and the second compression unit 12T include an annular first cylinder 121S and an annular second cylinder 121T in which a first suction port 135S and a second suction port 135T, and a first vane groove 128S and a second vane groove 128T are radially provided on a first laterally overhanging portion 122S and a second laterally overhanging portion 122T.

As illustrated in FIG. 2, in the first cylinder 121S and the second cylinder 121T, a circular first cylinder inner wall 123S and a circular second cylinder inner wall 123T are formed concentrically with the rotating shaft 15 of the motor 11. Inside the first cylinder inner wall 123S and the second cylinder inner wall 123T are arranged a first annular piston 125S and a second annular piston 125T, respectively, having an outer diameter smaller than a cylinder inner diameter. Between the first cylinder inner wall (inner peripheral surface) 123S and the second cylinder inner wall (inner peripheral surface) 123T and an outer peripheral surface 125Sa of the first annular piston 125S and an outer peripheral surface 125Ta of the second annular piston 125T are formed a first working chamber 130S and a second working chamber 130T that suction, compress, and discharge a refrigerant gas.

In the first cylinder 121S and the second cylinder 121T, a first vane groove 128S and a second vane groove 128T over an entire cylinder height are formed in a radial direction from the first cylinder inner wall 123S and the second cylinder inner wall 123T, and a first vane 127S and a second vane 127T each having a flat plate shape are slidably fitted into the first vane groove 128S and the second vane groove 128T. A cross section of the first vane 127S and the second vane 127T cut at a plane perpendicular to the rotating shaft 15, i.e., an end face of the vanes is an elongated rectangle composed of short and long sides. A short side width of the end face of the vanes is hereinafter referred to as an end face width of the first vane 127S and an end face width of the second vane 127T.

As illustrated in FIG. 2, at a far end of the first and second vane grooves 128S and 128T are formed a first spring hole 124S and a second spring hole 124T so as to communicate with the first vane groove 128S and the second vane groove 128T from an outer peripheral portion of the first cylinder 121S and the second cylinder 121T. Vane springs (not illustrated) that press a back surface of the first vane 127S and the second vane 127T are inserted into the first spring hole 124S and the second spring hole 124T. When the rotary compressor 1 is started up, the first vane 127S and the second vane 127T protrude from the inside of the first vane groove 128S and the second vane groove 128T into the first working chamber 130S and the second working chamber 130T due to repulsive force of the vane springs. Then, a leading end thereof abuts on the outer peripheral surfaces 125Sa, 125Ta of the first annular piston 125S and the second annular piston 125T, as a result of which the first vane 127S and the second vane 127T divides the first working chamber 130S and the second working chamber 130T into a first suction chamber 131S and a second suction chamber 131T, and a first compression chamber 133S and a second compression chamber 133T.

The first cylinder 121S and the second cylinder 121T are also formed with a first pressure introducing path 129S and a second pressure introducing path 129T that cause the far end of the first and second vane grooves 128S and 128T to communicate with an inside of the compressor housing 10 at an opening portion R illustrated in FIG. 1, introduce a compressed refrigerant gas in the compressor housing 10, and apply back pressure to the first vane 127S and the second vane 127T by pressure of the refrigerant gas.

The first cylinder 121S and the second cylinder 121T are provided with the first suction port 135S and the second suction port 135T that cause the first suction chamber 131S and the second suction chamber 131T to communicate with an outside in order to suction a refrigerant from the outside into the first suction chamber 131S and the second suction chamber 131T.

In addition, as illustrated in FIG. 1, an intermediate partition plate 140 is arranged between the first cylinder 121S and the second cylinder 121T to demarcate and close the first working chamber 130S of the first cylinder 121S and the second working chamber 130T of the second cylinder 121T. A lower end plate 160S is arranged at a lower end portion of the first cylinder 121S to close the first working chamber 130S of the first cylinder 121S. Additionally, an upper end plate 160T is arranged at an upper end portion of the second cylinder 121T to close the second working chamber 130T of the second cylinder 121T.

A sub bearing portion 161S is formed on the lower end plate 160S, and a sub shaft portion 151 of the rotating shaft 15 is rotatably supported by the sub bearing portion 161S. A main bearing portion 161T is formed on the upper end plate 160T, and a main shaft portion 153 of the rotating shaft 15 is rotatably supported by the main bearing portion 161T.

The rotating shaft 15 includes a first eccentric portion 152S and a second eccentric portion 152T that are eccentric with a phase shift of 180° from each other. The first eccentric portion 152S is rotatably fitted to the first annular piston 125S of the first compression unit 12S, and the second eccentric portion 152T is rotatably fitted to the second annular piston 125T of the second compression unit 12T.

When the rotating shaft 15 rotates, the first annular piston 125S and the second annular piston 125T revolve counterclockwise in FIG. 2 in the first cylinder 121S and the second cylinder 121T along the first cylinder inner wall 123S and the second cylinder inner wall 123T, and the first vane 127S and the second vane 127T reciprocate following that. The motions of the first and second annular pistons 125S and 125T and the first and second vanes 127S and 127T continuously change volumes of the first and second suction chambers 131S and 131T and the first and second compression chambers 133S and 133T, and the compression unit 12 continuously suctions, compresses, and discharges a refrigerant gas. A characteristic configuration of the compression unit 12 is described later.

As illustrated in FIG. 1, a lower muffler cover 170S is arranged on an underside of the lower end plate 160S, and a lower muffler chamber 180S is formed between the lower muffler cover 170S and the lower end plate 160S. Then, the first compression unit 12S is open to the lower muffler chamber 180S. In other words, near the first vane 127S on the lower endplate 160S is provided the first discharge port 190S (see FIG. 2) that allows the first compression chamber 133S of the first cylinder 121S to communicate with the lower muffler chamber 180S. The first discharge port 190S is arranged with a reed valve type first discharge valve 200S that prevents backflow of the compressed refrigerant gas.

The lower muffler chamber 180S is a single chamber formed in an annular shape, and is a part of a communication passage that allows a discharge side of the first compression unit 12S to communicate with an inside of the upper muffler chamber 180T through a refrigerant passage 136 (see FIG. 2) that penetrates through the lower end plate 160S, the first cylinder 121S, the intermediate partition plate 140, the second cylinder 121T, and the upper end plate 160T. The lower muffler chamber 180S reduces pressure pulsation of a discharged refrigerant gas. Additionally, a first discharge valve holder 201S for limiting an amount of deflection and opening of the first discharge valve 200S is fixed by rivets together with the first discharge valve 200S so as to overlap with the first discharge valve 200S. The first discharge port 190S, the first discharge valve 200S, and the first discharge valve holder 201S constitute a first discharge valve portion of the lower end plate 160S.

As illustrated in FIG. 1, an upper muffler cover 170T is arranged on an upper side of the upper end plate 160T, and an upper muffler chamber 180T is formed between the upper muffler cover 170T and the upper end plate 160T. Near the second vane 127T on the upper end plate 160T is provided the second discharge port 190T (see FIG. 2) that allows the second compression chamber 133T of the second cylinder 121T to communicate with the upper muffler chamber 180T. The second discharge port 190T is arranged with a reed valve type second discharge valve 200T that prevents backflow of the compressed refrigerant gas. Additionally, a second discharge valve holder 201T for limiting an amount of deflection and opening of the second discharge valve 200T is fixed by rivets together with the second discharge valve 200T so as to overlap with the second discharge valve 200T. The upper muffler chamber 180T reduces pressure pulsation of the discharged refrigerant. The second discharge port 190T, the second discharge valve 200T, and the second discharge valve holder 201T constitute a second discharge valve portion of the upper endplate 160T.

The first cylinder 121S, the lower end plate 160S, the lower muffler cover 170S, the second cylinder 121T, the upper end plate 160T, the upper muffler cover 170T, and the intermediate partition plate 140 are integrally fastened by a plurality of through bolts 175 and the like. In the compression unit 12 integrally fastened by the through bolts 175 and the like, an outer peripheral portion of the upper end plate 160T is secured by spot welding to the compressor housing 10 to fix the compression unit 12 to the compressor housing 10.

On an outer peripheral wall of the cylindrical compressor housing 10, first and second through holes 101 and 102 are provided apart axially and in order from the lower part in order to allow first and second suction pipes 104 and 105 to pass therethrough. In addition, on an outer side portion of the compressor housing 10, an accumulator 25 composed of an independent cylindrical sealed container is held by an accumulator holder 252 and an accumulator band 253.

A system connection pipe 255 connected to an evaporator of a refrigeration cycle is connected to a top part center of the accumulator 25. A bottom through hole 257 provided at a bottom of the accumulator 25 is connected to a first low-pressure connection pipe 31S and a second low-pressure connection pipe 31T, one end of which is extended to an internal upper part of the accumulator 25, and an other end of which is connected to an other end of the first suction pipe 104 and the second suction pipe 105.

The first low-pressure connection pipe 31S and the second low-pressure connection pipe 31T, which guide a low-pressure refrigerant of the refrigeration cycle to the first compression unit 12S and the second compression unit 12T via the accumulator 25, are connected to the first suction port 135S and the second suction port 135T (see FIG. 2) of the first cylinder 121S and the second cylinder 121T via the first suction pipe 104 and the second suction pipe 105 serving as a suction unit. In other words, the first suction port 135S and the second suction port 135T are connected in parallel to the evaporator of the refrigeration cycle.

A discharge pipe 107, which serves as a discharge unit that is connected to the refrigeration cycle and that discharges a high-pressure refrigerant gas to a condenser side of the refrigeration cycle, is connected to a top part of the compressor housing 10. In other words, the first discharge port 190S and the second discharge port 190T are connected to the condenser of the refrigeration cycle.

Lubricating oil is sealed in the compressor housing 10 approximately up to the height of the second cylinder 121T. Additionally, the lubricating oil is sucked up through an oil supply pipe 16 attached to a lower end portion of the rotating shaft 15 by a vane pump (not illustrated) inserted into a lower part of the rotating shaft 15, and circulates through the compression unit 12, lubricating sliding components and sealing minute gaps in the compression unit 12.

Figure 3:
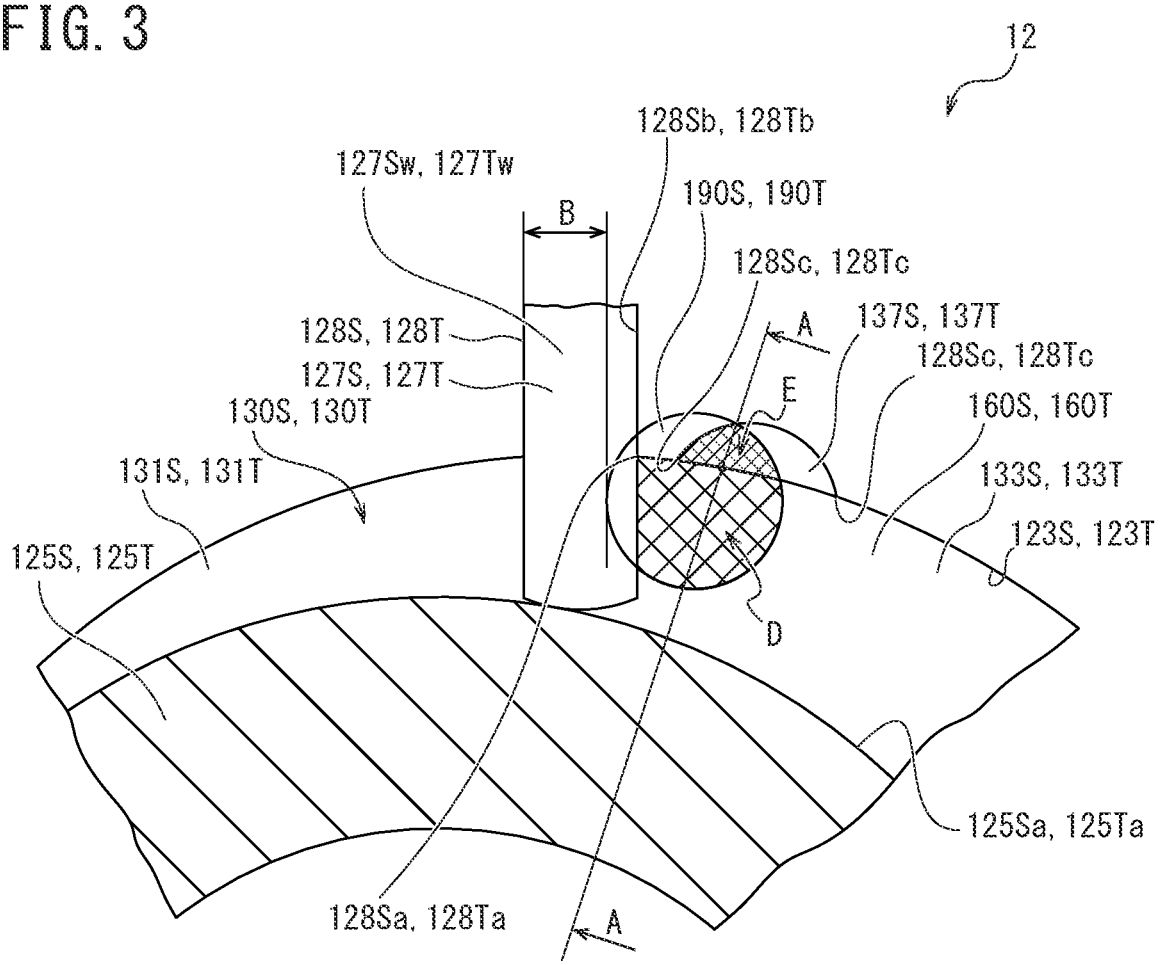
FIG. 3 is an enlarged plan view of the compression unit of Example 1.
Figure 4:
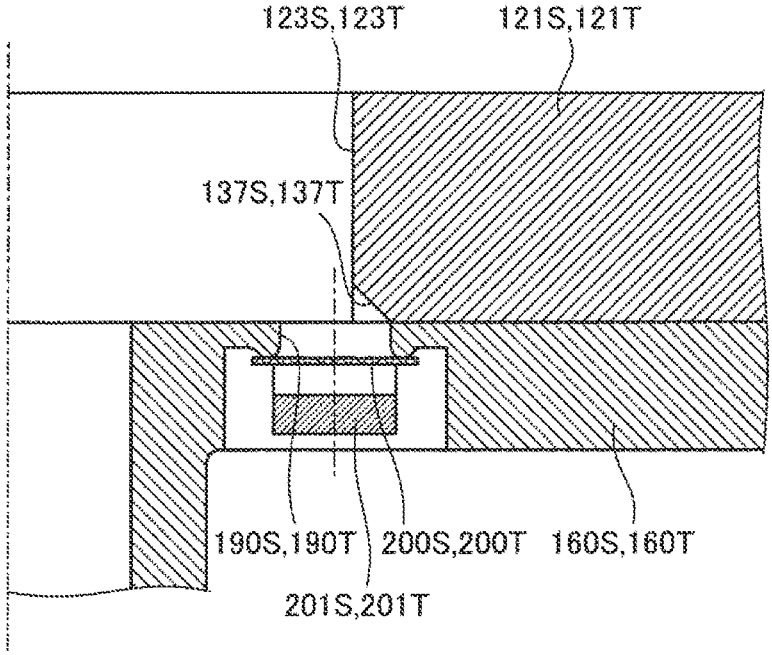
FIG. 4 is a cross-sectional view taken along line A-A of FIG. 3.
Figure 5:
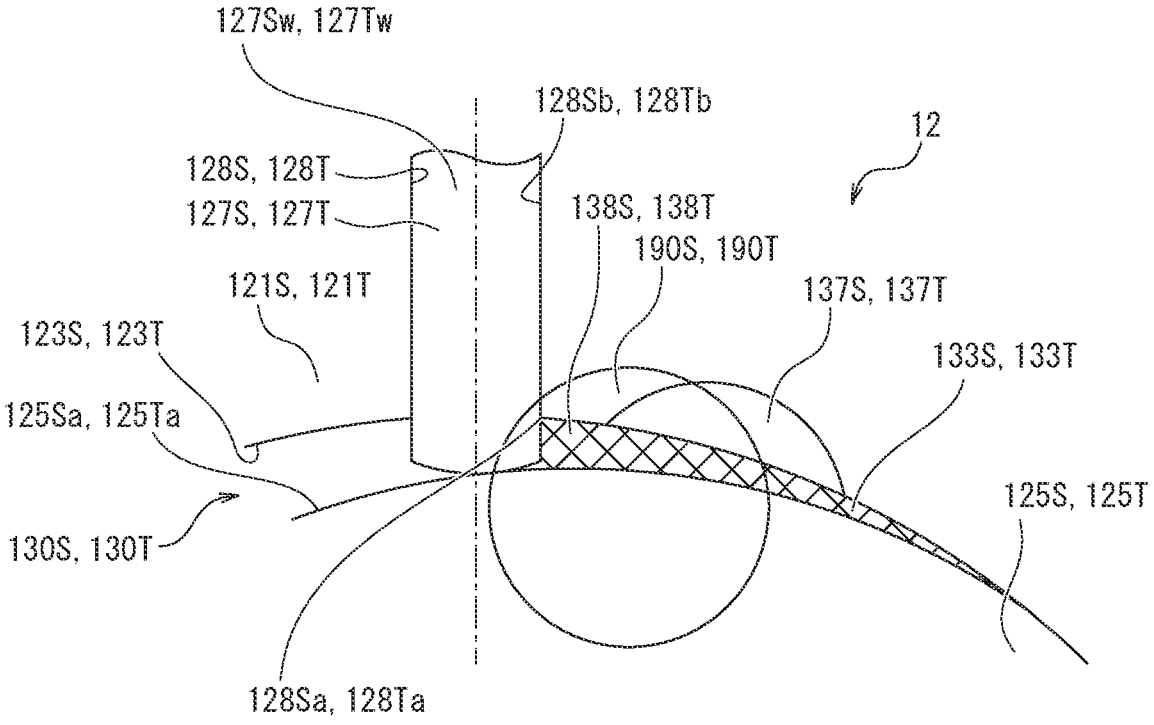
FIG. 5 is an enlarged plan view illustrating the compression unit immediately before a top dead center.

Next, a characteristic configuration of the rotary compressor 1 of Example 1 is described with reference to FIGS. 3 to 5. FIG. 3 is an enlarged plan view of the compression unit illustrated in FIG. 2, FIG. 4 is a cross-sectional view taken along line A-A of FIG. 3, and FIG. 5 is an enlarged plan view of the compression unit when the annular pistons are located immediately before of the top dead center. Note that in the following description, for the common configuration contents, such as the first annular piston 125S and the second annular piston 125T, the "first" and the "second" in the names and the subscripts "S" and "T" in the reference signs may be omitted, and duplicate descriptions thereof may be omitted.

The first discharge port 190S and the second discharge port 190T communicating with the first compression chamber 133S and the second compression chamber 133T are provided on the first compression chamber 133S side and the second compression chamber 133T side of the lower end plate 160S and the upper end plate 160T. The first discharge port 190S and the second discharge port 190T are partially located outside the first cylinder inner wall 123S and the second cylinder inner wall 123T, and are positioned to face a first corner portion 128Sa and a second corner portion 128Ta (hereinafter referred to as the first corner portion 128Sa and the second corner portion 128Ta of the vane groove and the compression chamber-side cylinder inner wall) formed by a first vane groove inner wall 128Sb of the first vane groove 128S and a second vane groove inner wall 128Tb of the second vane groove 128T and the first cylinder inner wall 123S and the second cylinder inner wall 123T on the compression chamber side. In other words, the first discharge port 190S and the second discharge port 190T are arranged so that the first corner portion 128Sa of the vane groove and the compression chamber-side cylinder inner wall and the second corner portion 128Ta of the vane groove and the compression chamber-side cylinder inner wall are placed thereinside when viewed from an axial direction of the rotating shaft 15.

The first cylinder 121S and the second cylinder 121T on the first compression chamber 133S side and the second compression chamber 133T side are formed with a first discharge groove 137S and a second discharge groove 137T opening on the first cylinder inner wall 123S and the second cylinder inner wall 123T, and an end face of the first cylinder 121S and the second cylinder 121T. The first discharge groove 137S and the second discharge groove 137T allow the first compression chamber 133S and the second compression chamber 133T to communicate with the first discharge port 190S and the second discharge port 190T. First edge portions 128Sc and second edge portions 128Tc on both sides of the first discharge groove 137S and the second discharge groove 137T formed by the inner peripheral wall of the first discharge groove 137S and the second discharge groove 137T and the cylinder inner wall 123S on the first compression chamber 133S side and the cylinder inner wall 123T on the second compression chamber 133T side are positioned away from the first corner portion 128Sa and the second corner portion 128Ta of the vane groove and the compression chamber-side cylinder inner wall.

An opening of the first discharge groove 137S and the second discharge groove 137T formed on the end face of the first cylinder 121S and the second cylinder 121T is arcuate, and have a radius of curvature R2 equal to or approximating a radius R1 of the first and second discharge ports 190S and 190T (for example, $0.9R1 \leq R2 \leq 1.1R1$). The opening is formed in a semicircular (or a semi-conical) shape inclined from the end face of the first cylinder 121S and the second cylinder 121T toward the first cylinder inner wall 123S and the second cylinder inner wall 123T so that a depth from the first cylinder inner wall 123S and the second cylinder inner wall 123T becomes shallower from the opening formed on the end face of the first cylinder 121S and the second cylinder 121T toward an interior side thereof. As illustrated in FIG. 4, the first discharge groove 137S and the second discharge groove 137T are formed only on a portion of the first cylinder inner wall 123S and the second cylinder inner wall 123T close to the lower end plate 160S and the upper end plate 160T. This is because forming the first and second discharge grooves 137S and 137T across an entire vertical region of the first and second cylinder inner walls 123S and 123T reduces mechanical strength of the first and second cylinders 121S and 121T, and causes a compressed refrigerant gas remaining in the first and second discharge grooves 137S and 137T to flow back into the first and second compression chambers 133S and 133T, reducing volumetric efficiency of refrigerant compression.

As illustrated in FIG. 5, in the rotary compressor 1 of Example 1, the first discharge port 190S and the second discharge port 190T are positioned to face the first corner portion 128Sa and the second corner portion 128Ta of the vane groove and the compression chamber-side cylinder inner wall. Therefore, by the time the first and second annular pistons 125S and 125T revolve counterclockwise to reach the top dead center, a first small space 138S and a second small space 138T (a hatched portion in FIG. 5) formed being surrounded by the first and second cylinder inner walls 123S and 123T, the first and second outer peripheral surfaces 125Sa and 125Ta of the first and second annular pistons 125S and 125T, and the first and second vanes 127S and 127T communicate with the first discharge port 190S and the second discharge port 190T. This allows the compressed refrigerant gas in the first and second small spaces 138S and 138T to escape into the first and second discharge ports 190S and 190T, which prevents over-compression of the refrigerant to reduce over-compression loss, improving compression efficiency.

Additionally, in the rotary compressor 1 of Example 1, the first edge portions 128Sc and the second edge portions 128Tc on both sides of the first discharge groove 137S and the second discharge groove 137T formed by the inner peripheral wall of the first discharge groove 137S and the second discharge groove 137T and the compression chamber-side cylinder inner walls 123S and 123T are positioned away from the first corner portion 128Sa and the second corner portion 128Ta of the vane groove and the compression chamber-side cylinder inner wall. Therefore, a wall portion formed by the first vane groove inner wall 128Sb and the second vane groove inner wall 128Tb and the inner peripheral surface of the first discharge groove 137S and the second discharge groove 137T is not formed into an acute angle shape, which can therefore suppress an end portion thereof from becoming easily chipped.

Figure 8:
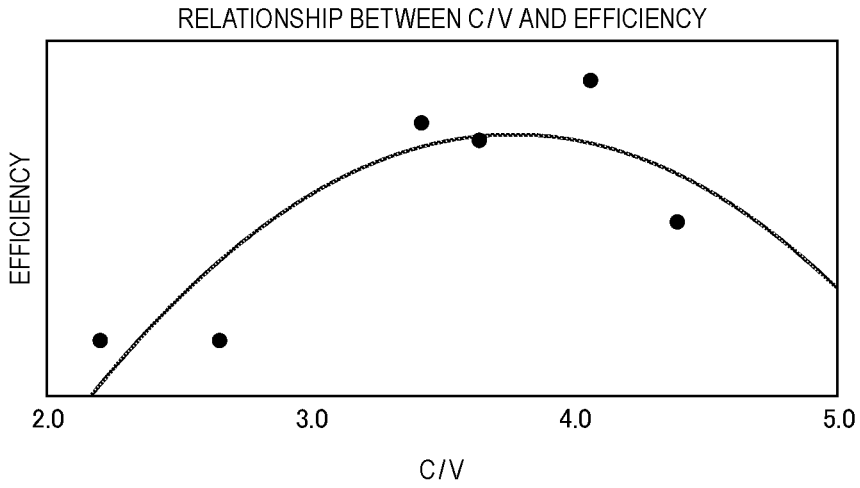
FIG. 8 is a diagram illustrating a relationship between a ratio C/V of an inlet area C of a discharge port of Example 1 to an exclusion volume V of a cylinder of the compression unit and efficiency.

Next, a relationship between a ratio C/V of an inlet area C ($mm^2$) of the first and second discharge ports 190 to an exclusion volume V ($mm^3$) of the cylinder 121 and an efficiency E of the rotary compressor 1 is described with reference to FIGS. 3 and 8.

The inlet area C of the discharge ports 190 is a range indicated by the hatching in FIG. 3. The inlet area C is a sum of an area D of a portion where the discharge ports 190 are exposed on the end plate 160 without overlapping with the vane 127 and the end face of the cylinder 121 and an area E of a portion where the discharge ports 190 and the discharge grooves 137 overlap. The inlet area C is a substantial area of the discharge ports 190 through which the compressed refrigerant flows. As is clear from FIG. 8, experimental results show that the efficiency E is improved by setting $3.0 \leq C/V$ to $\leq 4.5$.

Figure 9:
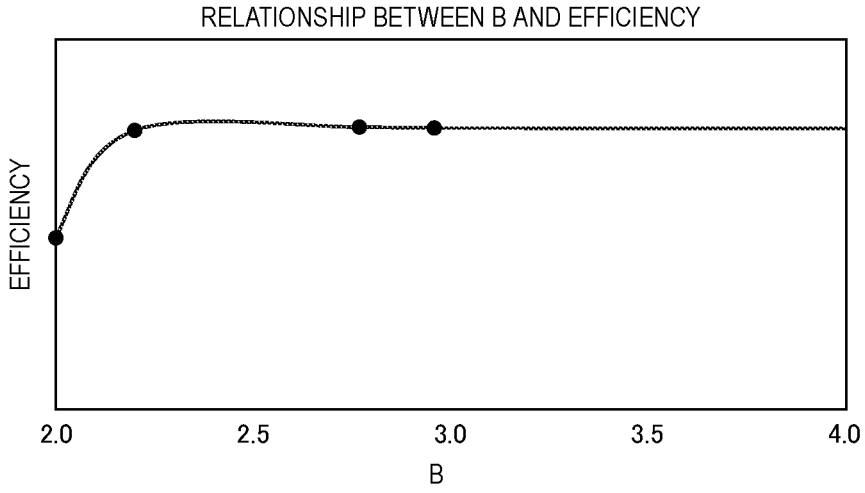
FIG. 9 is a diagram illustrating a relationship between a seal width B of vanes of Example 1 and efficiency.

Next, a relationship between a seal width B (an end face width of the vanes 127) of the discharge ports 190 and the vanes 127 and the efficiency E of the rotary compressor 1 is described with reference to FIGS. 3 and 9.

The seal width B of the discharge ports 190 and the vanes 127 is a width of the vanes 127 excluding a portion where the discharge ports 190 and the vanes 127 overlap in a widthwise direction of the vanes 127, as illustrated in FIG. 3. As is clear from FIG. 9, experimental results show that the efficiency E is improved by setting 2.2 (mm)≤B.

Note that although in Example 1, the first cylinder inner wall 123S and the second cylinder inner wall 123T are provided with the first discharge groove 137S and the second discharge groove 137T that allow the first compression chamber 133S and the second compression chamber 133T to communicate with the first discharge port 190S and the second discharge port 190T, the first and second discharge grooves 137S and 137T do not necessarily have to be provided. However, providing the first and second discharge grooves 137S and 137T is effective to sufficiently secure the inlet area C of the first and second discharge ports 190S and 190T, so that it is preferable to provide the first and second discharge grooves 137S and 137T.

Example 2

Figure 6:
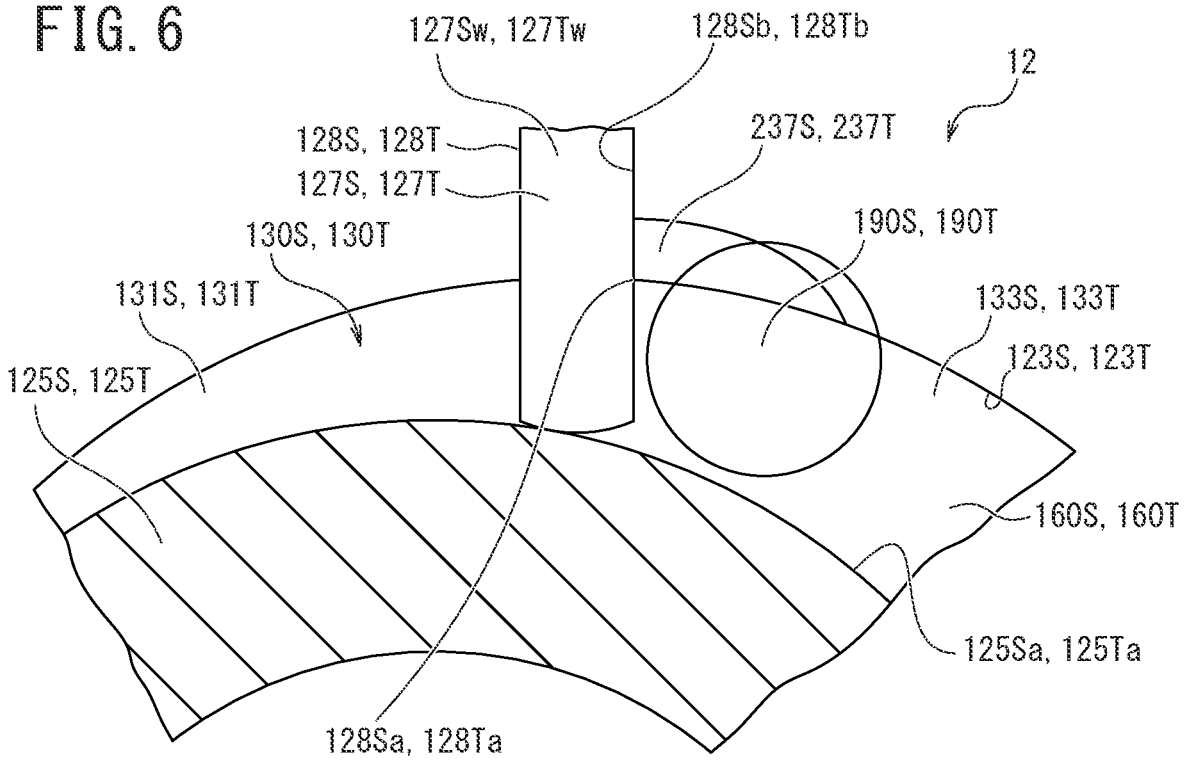
FIG. 6 is an enlarged plan view illustrating a compression unit of Example 2.

Next, a characteristic configuration of the rotary compressor 1 of Example 2 is described with reference to FIG. 6. Note that the components common to Example 1 are denoted by the same reference signs, and detailed description thereof is omitted. FIG. 6 is an enlarged cross-sectional view illustrating first and second compression units of Example 2.

As illustrated in FIG. 6, the first discharge port 190S and the second discharge port 190T, which are partially located outside the first cylinder inner wall 123S and the second cylinder inner wall 123T and which communicate with the first compression chamber 133S and the second compression chamber 133T, are provided near the first vane groove 128S and the second vane groove 128T on the first compression chamber 133S side and the second compression chamber 133T side of the lower end plate 160S and the upper end plate 160T so as not to overlap with the first vane 127S and the second vane 127T.

In addition, the first cylinder 121S and the second cylinder 121T on the first compression chamber 133S side and the second compression chamber 133T side are formed with a first discharge groove 237S and a second discharge groove 237T opening on the first cylinder inner wall 123S and the second cylinder inner wall 123T, and the end face of the first cylinder 121S and the second cylinder 121T. The first discharge groove 237S and the second discharge groove 237T allow the first compression chamber 133S and the second compression chamber 133T to communicate with the first discharge port 190S and the second discharge port 190T. Additionally, the first discharge groove 237S and the second discharge groove 237T are also open on the first vane groove inner wall 128Sb and the second vane groove inner wall 128Tb on the first compression chamber 133S side and the second compression chamber 133T side.

An opening of the first discharge groove 237S and the second discharge groove 237T formed on the end face of the first cylinder 121S and the second cylinder 121T is arcuate, and has a radius of curvature larger than the radius R1 of the first and second discharge ports 190S and 190T. The opening is formed in a semicircular (or a semi-conical) shape inclined from the end face of the first and second cylinders 121S and 121T toward the first and second cylinder inner walls 123S and 123T so that the depth from the first and second cylinder inner walls 123S and 123T becomes shallower from the opening formed on the end face of the first and second cylinders 121S and 121T toward the interior side thereof. In addition, an angle of an edge portion formed by intersection of an inner peripheral wall of the first discharge groove 237S and the second discharge groove 237T and the first vane groove inner wall 128Sb and the second vane groove inner wall 128Tb of the first vane groove 128S and the second vane groove 128T is a substantially right angle or an angle greater than a right angle.

Figure 7:
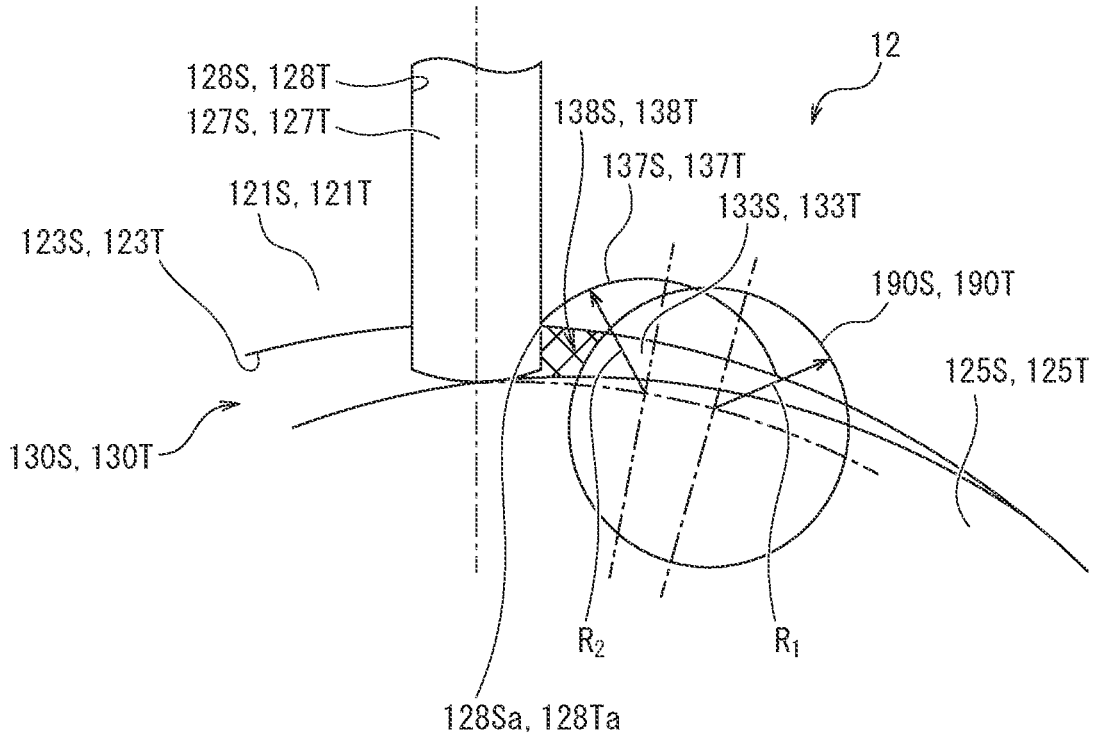
FIG. 7 is a plan view illustrating a compression unit of a conventional rotary compressor.

In the rotary compressor 1 of Example 2, even after the first annular piston 125S and the second annular piston 125T revolve counterclockwise, then a contact point between the first and second annular pistons 125S and 125T and the first and second cylinder inner walls 123S and 123T approaches the first and second vane grooves 128S and 128T, and the first and second annular pistons 125S and 125T completely close the first and second discharge ports 190S and 190T, the first and second discharge grooves 237S and 237T allow the first and second small spaces 138S and 138T (see FIG. 7) of the first and second compression chambers 133S and 133T to communicate with the first and second discharge ports 190S and 190T to cause the compressed refrigerant gas in the first and second small spaces 138S and 138T to escape into the first and second discharge ports 190S, 190T, which prevents over-compression of the refrigerant to reduce over-compression loss, enabling improved compression efficiency.

Furthermore, in the rotary compressor 1 of Example 2, the angle of an edge portion formed by intersection of the inner peripheral wall of the first and second discharge grooves 237S and 237T and the first and second vane groove inner walls 128Sb and 128Tb of the first and second vane grooves 128S and 128T is a substantially right angle or an angle greater than a right angle. Thus, a wall portion formed by the first and second vane groove inner walls 128Sb and 128Tb and the inner peripheral surface of the first and second discharge grooves 237S and 237T is not formed into an acute angle shape, which can therefore suppress an end portion thereof from being easily chipped.

Note that although in Examples 1 and 2, Examples of a twin cylinder rotary compressor have been described, the rotary compressors of the present Examples can also be applied to single cylinder rotary compressors and two-stage compression type rotary compressors.

REFERENCE SIGNS LIST

1: Rotary compressor
10: Compressor housing (sealed container)
11: Motor
12S, T: Compression unit
15: Rotating shaft
121S, T: Cylinder
123S, T: Cylinder inner wall
125S, T: Annular piston
125Sa, Ta: Outer peripheral surface of annular piston
127S, T: Vane
127Sw, Tw: End face of vane
128S, T: Vane groove
128Sa, Ta: Corner portion of vane groove and compression chamber-side cylinder inner wall
128Sb, Tb: Inner wall of vane groove
128Sc, Tc: Edge portion of discharge groove
130S, T: Working chamber
131S, T: Suction chamber
133S, T: Compression chamber
135S, T: Suction port
137S, T: Discharge groove
138S, T: Small space
152S, T: Eccentric portion
160S, T: End plate
190S, T: Discharge port
237S, T: Discharge groove

The invention claimed is:

1. A rotary compressor comprising:
an annular cylinder including a suction port and a vane groove;
an end plate configured to close an end portion of the cylinder;
a discharge port provided on the end plate and partially located outside a cylinder inner wall of the cylinder;
an annular piston fitted to an eccentric portion of a rotating shaft rotationally driven by a motor, the annular piston revolving in the cylinder along the cylinder inner wall to form a working chamber with the cylinder inner wall; and
a vane configured to protrude into the working chamber from the vane groove provided in the cylinder and abut on the annular piston to divide the working chamber into a suction chamber communicating with the suction port and a compression chamber communicating with the discharge port, wherein
the compression chamber compresses a refrigerant by contracting as the annular piston revolves,
the discharge port overlaps a corner portion formed by an inner wall of the vane groove and the cylinder inner wall on the compression chamber side,
the cylinder inner wall on the compression chamber side is formed with a discharge groove communicating with the compression chamber and the discharge port, edge portions on both sides of the discharge groove formed by an inner peripheral wall of the discharge groove and the cylinder inner wall being away from the corner portion formed by the inner wall of the vane groove and the cylinder inner wall on the compression chamber side, and
a part of the discharge groove protrudes beyond the discharge port in a circumferential direction of the cylinder and in a direction opposite to a direction of revolution of the annular piston.

2. The rotary compressor according to claim 1, wherein a width B of a portion of an end face width of the vane not overlapping with the discharge port satisfies the following relational expression:

$$2.2\ (\mathrm{mm}) \leq B.$$

3. A rotary compressor comprising:
an annular cylinder including a suction port and a vane groove;
an end plate configured to close an end portion of the cylinder;
a discharge port provided on the end plate and partially located outside a cylinder inner wall of the cylinder;
an annular piston fitted to an eccentric portion of a rotating shaft rotationally driven by a motor, the annular piston revolving in the cylinder along the cylinder inner wall to form a working chamber with the cylinder inner wall; and
a vane configured to protrude into the working chamber from the vane groove provided in the cylinder and abut on the annular piston to divide the working chamber into a suction chamber communicating with the suction port and a compression chamber communicating with the discharge port, wherein
the compression chamber compresses a refrigerant by contracting as the annular piston revolves,
the discharge port overlaps a corner portion formed by an inner wall of the vane groove and the cylinder inner wall on the compression chamber side,
the cylinder inner wall on the compression chamber side is formed with a discharge groove communicating with the compression chamber and the discharge port, edge portions on both sides of the discharge groove formed by an inner peripheral wall of the discharge groove and the cylinder inner wall being away from the corner portion formed by the inner wall of the vane groove and the cylinder inner wall on the compression chamber side, and an inlet area C of the discharge port and an exclusion volume V of the cylinder satisfy the following relational expression:

$$C=D+E$$

D=an area of a portion where the discharge port is exposed on the end plate

E=an area of a portion where the discharge port and the discharge groove overlap $$3.0\ (\mathrm{mm}^{-1}) \leq C/V \leq 4.5\ (\mathrm{mm}^{-1}).$$

4. A rotary compressor comprising:

an annular cylinder including a suction port and a vane groove;

an end plate configured to close an end portion of the cylinder;

a discharge port provided on the end plate and partially located outside a cylinder inner wall of the cylinder;

an annular piston fitted to an eccentric portion of a rotating shaft rotationally driven by a motor, the annular piston revolving in the cylinder along the cylinder inner wall to form a working chamber with the cylinder inner wall; and a vane configured to protrude into the working chamber from the vane groove provided in the cylinder and abut on the annular piston to divide the working chamber into a suction chamber communicating with the suction port and a compression chamber communicating with the discharge port, wherein a discharge groove is formed on the cylinder inner wall on the compression chamber side, the discharge groove communicating with the compression chamber and the discharge port, the compression chamber compresses a refrigerant by contracting as the annular piston revolves, a part of the discharge groove protrudes beyond the discharge port in a circumferential direction of the cylinder and in a direction of revolution of the annular piston, and the discharge groove is open on an inner wall of the vane groove on the compression chamber side.

5. A rotary compressor comprising:

an annular cylinder including a suction port and a vane groove;

an end plate configured to close an end portion of the cylinder;

a discharge port provided on the end plate and partially located outside a cylinder inner wall of the cylinder;

an annular piston fitted to an eccentric portion of a rotating shaft rotationally driven by a motor, the annular piston revolving in the cylinder along the cylinder inner wall to form a working chamber with the cylinder inner wall; and a vane configured to protrude into the working chamber from the vane groove provided in the cylinder and abut on the annular piston to divide the working chamber into a suction chamber communicating with the suction port and a compression chamber communicating with the discharge port, wherein the compression chamber compresses a refrigerant by contracting as the annular piston revolves, and the discharge port overlaps a corner portion formed by an inner wall of the vane groove and the cylinder inner wall on the compression chamber side, a width B of a portion of an end face width of the vane not overlapping with the discharge port satisfies the following relational expression:

$$2.2\ (\mathrm{mm}) \leq B,$$

the cylinder inner wall on the compression chamber side is formed with a discharge groove communicating with the compression chamber and the discharge port, edge portions on both sides of the discharge groove formed by an inner peripheral wall of the discharge groove and the cylinder inner wall being away from the corner portion formed by the inner wall of the vane groove and the cylinder inner wall on the compression chamber side, and an inlet area C of the discharge port and an exclusion volume V of the cylinder satisfy the following relational expression:

$$C=D+E$$

D=an area of a portion where the discharge port is exposed on the end plate

E=an area of a portion where the discharge port and the discharge groove overlap $$3.0\ (\mathrm{mm}^{-1}) \leq C/V \leq 4.5\ (\mathrm{mm}^{-1}).$$

* * * * *